United States Patent [19]

Braggins, Jr.

[11] 4,434,564

[45] Mar. 6, 1984

[54] HEAT RECOVERY SYSTEM FOR CLOTHES DRYERS AND THE LIKE

[76] Inventor: John C. Braggins, Jr., 8521 Lowell Blvd., Westminster, Colo. 80030

[21] Appl. No.: 768,823

[22] Filed: Feb. 15, 1977

[51] Int. Cl.[2] ..... F26B 19/00; B01D 50/00

[52] U.S. Cl. ..... 34/86; 34/82; 34/235; 55/319; 55/321; 55/442

[58] Field of Search ..... 34/86, 82, 133, 235, 34/90, 231; 55/309, 319, 321, 442, 443, DIG. 37

[56] References Cited

U.S. PATENT DOCUMENTS

| | | | |
|---|---|---|---|
| 1,521,262 | 12/1924 | Wainwright | 55/442 |
| 1,739,367 | 12/1929 | Love | 55/442 |
| 1,821,842 | 9/1931 | Long | 55/319 |
| 2,509,300 | 5/1950 | Hendrickson | 34/82 |
| 2,735,507 | 2/1956 | Vogel | 34/82 |
| 2,849,080 | 8/1958 | Enright | 55/442 |
| 3,047,963 | 8/1962 | Richterkessing | 34/82 |
| 3,096,165 | 7/1963 | Lane | 34/86 |
| 3,256,679 | 6/1966 | Snyder | 55/321 |
| 3,716,925 | 2/1973 | Hartung | 34/235 |
| 3,792,671 | 2/1974 | Woods | 110/119 |
| 3,992,177 | 11/1976 | Welteroth | 55/319 |
| 3,999,304 | 12/1976 | Doty | 34/86 |

*Primary Examiner*—James C. Yeung
*Attorney, Agent, or Firm*—John E. Reilly

[57] ABSTRACT

A heat recovery device is adapted for placement in the heat exhaust vent pipe of a conventional clothes dryer. The device includes a scrubber for primary removal of lint from the dryer exhaust and a final filter means for removing small particles of lint remaining prior to allowing the warm, humid dryer exhaust air to pass into the atmosphere of the interior environment of a home. The scrubber includes a series of ducts opening into an enlarged plenum and a baffle plate in the plenum to inhibit streamlined flow of air allowing the lint to settle to the bottom of the plenum, and the final filter includes a series of expanded aluminum screens or mesh for positively prohibiting passage of lint into the atmosphere. A clean-out tray is provided at the bottom of the plenum to facilitate removal of lint from the plenum for disposal. The device also includes a bypass duct for passing the dryer exhaust air through the device and to the outside of the home and a valve for selectively directing the flow of air through the scrubber or through the bypass duct as desired.

23 Claims, 5 Drawing Figures

HEAT RECOVERY SYSTEM FOR CLOTHES DRYERS AND THE LIKE

BACKGROUND OF THE INVENTION

The present invention generally concerns heat conservation devices for clothes dryers and more particularly an exhaust air diversion device with lint scrubber apparatus adapted to be positioned in the exhaust air vent pipe of a clothes dryer for diverting warm, humid exhaust air from the dryer into the interior environment of a home.

Electric and gas heated clothes dryers have become common household appliances during the past several decades for drying clothes inside homes after washing. These dryers essentially operate by tumbling the wet clothes in a large revolving cylinder or drum while forcing hot air through the cylinder to pick up the moisture from the clothes and carry it out of the dryer. It is conventional to vent or exhaust the warm, humid air to the outside of the house.

In recent years, however, the rapid rise in energy costs for homeowners has made the practice of venting or exhausting the hot air from a clothes dryer to the outside a conspicous waste of energy resulting from loss of heat as well as humidity which could be utilized at least to some extent in the environment inside the home. The practice of venting this air outside is particularly inefficient in the winter months when it is quite common, in fact necessary in many geographical locations, to concurrently use furnaces for heating and humidifiers for adding humidity to the air in the inside environment in the home at the same time the warm, humid air from the clothes dryer is being exhausted to the outside.

There are several problems associated with simply venting the exhaust from the dryer directly into the inside environment of the home which have resulted in the conventional practice of venting or exhausting the air to the outside. One of the problems is that the exhaust air from the dryer contains a certain amount of lint which is picked up from the clothes. Even though most dryers include some provisions for lint traps or screens, none of these conventional devices supplied by the manufacturers are efficient enough to eliminate all the lint in the exhaust air, and projecting the lint into the inside environment of the home is quite undesirable from both health and a practical cleaning standpoint. Another problem of course is the inability to regulate the heat and humidity to desirable levels during the several seasons of the year if the exhaust is simply vented directly into the inside environment.

SUMMARY OF THE INVENTION

Accordingly, it is an object of the present invention to provide a novel and improved heat recovery device which is capable of diverting the air from the outside exhaust vent pipe of a conventional clothes dryer and the like for discharge into the inside environment of a home.

It is also an object of the present invention to provide a heat recovery device including apparatus for scrubbing lint from the exhaust air of a clothes dryer.

It is another object of the present invention to provide a heat recovery device as described above with convenient lint removal and cleaning apparatus.

A still further object of the present invention is to provide a heat recovery device for placement in the exhaust air vent pipe of a conventional clothes dryer including a diversion valve for selectively diverting dryer exhaust air into the interior environment of a home or alternatively allowing the exhaust air to pass to the outside of the home.

The heat recovery device of the present invention includes an enclosed chamber having an inlet port for receiving exhausted air from a clothes dryer, an indoors exhaust opening through which the dryer exhaust air can be discharged into the interior environment of a home, and scrubber means within the chamber for removing lint from the exhausted dryer air prior to discharge into the interior environment. The scrubber means includes a series of ducts opening into an enlarged plenum and a baffle plate on one side of the plenum for dispersing and reducing the velocity of the airstream while changing its direction of flow through the chamber by means of slots so as to allow lint particles to settle out of the air.

The indoors exhaust opening is also provided with final filter means in the form of several layers of expanded aluminum mesh to filter any remaining lint particles in the air so that only warm, humid air with no lint particles is discharged into the interior home environment. The device also has a lint tray positioned at the bottom of the plenum which is removable from the front of the device to facilitate removing and disposing of the lint trapped in the plenum.

The device also includes a bypass duct and a valve which is operative to selectively divert the exhaust air from the dryer either into the interior environment of the home or allowed to pass to the outside of the home as desired at any particular time to maintain the optimum of heat and humidity in the home whille the dryer is operating.

Other objects, advantages and capabilities of the present invention will become more apparent as the description proceeds taken in conjunction with the accompanying drawings, in which:

DETAILED DESCRIPTION OF THE PREFERRED EMBODIMENT

Figure 1:
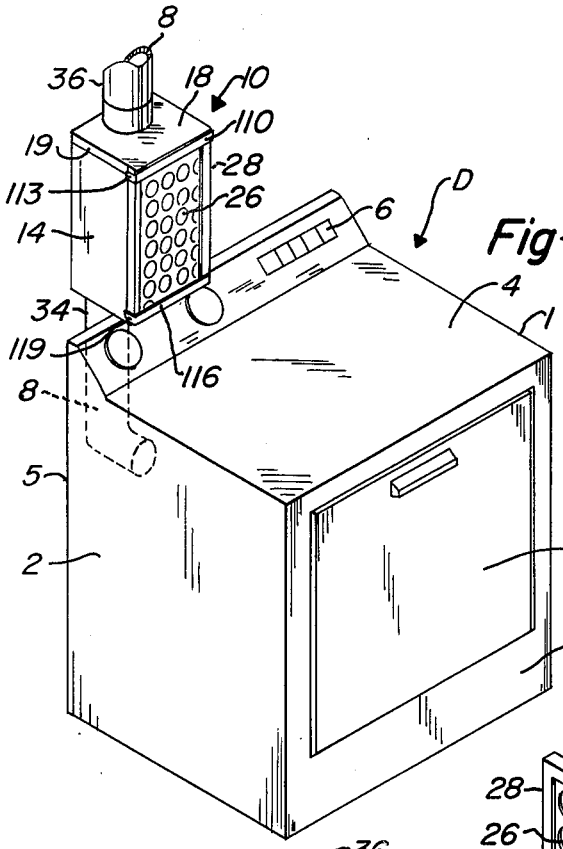
FIG. 1 is a perspective view of a conventional home clothes dryer equipped with the heat recovery device of this invention.

A heat recovery device 10 formed in accordance with the present invention is shown in FIG. 1 attached to the warm air vent exhaust pipe 8 of a conventional home dryer D. The dryer D is shown for illustrative purposes only; it does not form a part of this invention. It is of conventional form with right and left side panels 1, 2, respectively, a front panel 3, top panel 4, and rear panel 5. A control or instrument panel 6 is provided toward the rear of the top panel 4, and an access door 7 is provided in the front panel 3 for loading and unloading the dryer D. The exhaust vent pipe 8 is conventional and extends from the rear of the dryer D to conduct the warm, moist exhaust air from the dryer to the outside of the house in the conventional manner.

Figure 2:
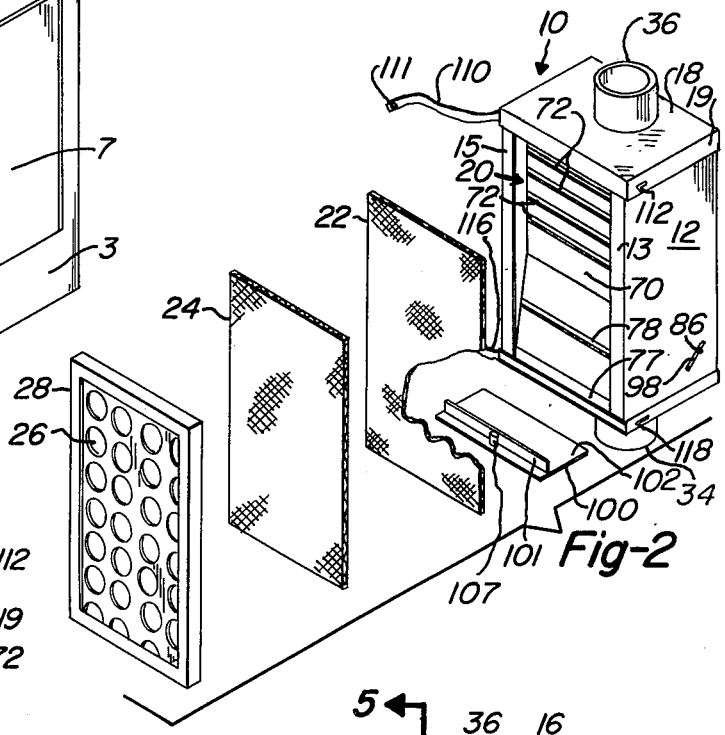
FIG. 2 is a perspective view of the heat recovery device shown with the final filter and the lint tray removed, a portion of the inner filter being cut away to reveal the entire lint tray.
Figure 3:
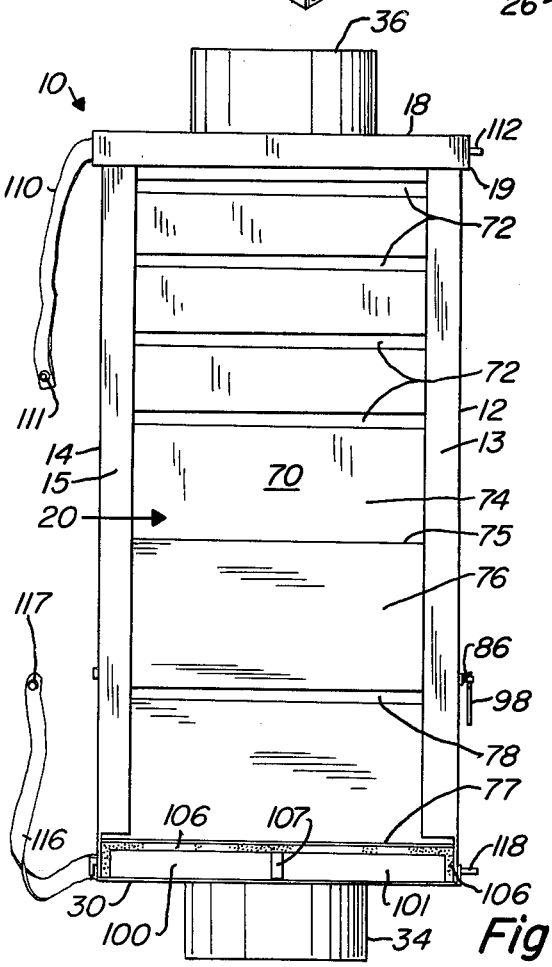
FIG. 3 is a front elevation of the heat recovery device with the final filters removed and the lint tray in place.

The heat recovery device 10 of the present invention is placed in the exhaust vent pipe 8 for the purpose of diverting the warm, moist air being exhausted from the dryer into the interior environment of the home. Basically, the heat recovery device 10 is comprised of a chamber defined by right and left side panels 12, 14, respectively, rear panels 16, top lid 18, and bottom plate 30. The dryer exhaust air is introduced into the rear portion of the chamber through inlet port 34 where it is conducted by a series of ducts through a lint scrubber for removing any lint being carried by the dryer exhaust air prior to discharging the air into the interior home environment. The open front 20, as best seen in FIGS. 2 and 3, provides an interior outlet opening for discharging the exhaust air into the interior environment of the home.

Figure 5:
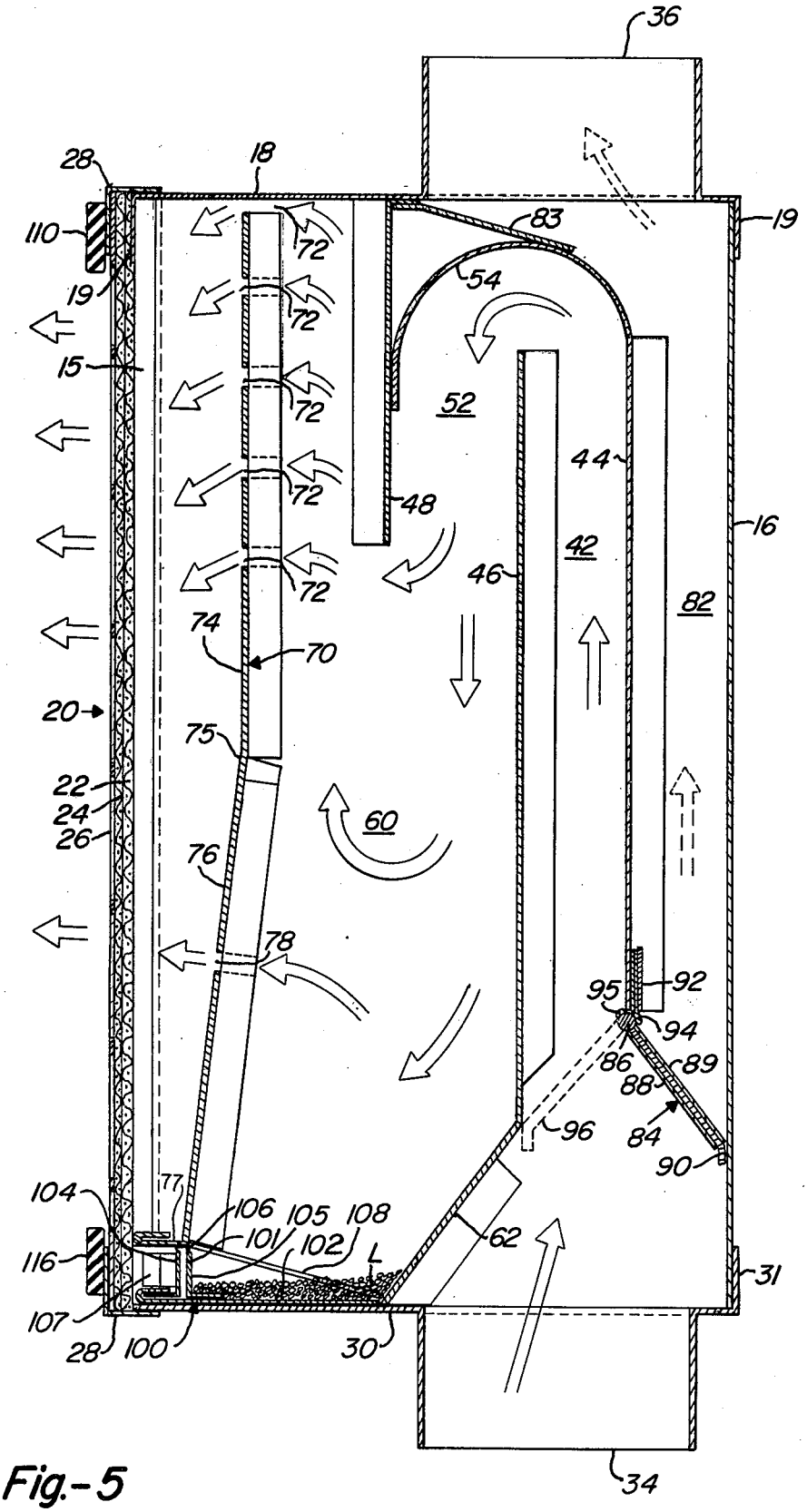
FIG. 5 is an enlarged cross-section of the heat recovery device taken along lines 5—5 of FIG. 4.

As best seen in FIG. 5, the lint scrubber includes an initial duct 42 in communication with the inlet port 34 and an intermediate duct 52 adjacent the initial duct 42. The initial duct 42 is formed by partition 44 on one side and partition 46 on the other side. Intermediate duct 52 is also defined by a common partition 46 on one side and a partial partition 48 extending downwardly into the enlarged plenum 60 such that initial duct 42 and intermediate duct 52 are situated adjacent each other and in communication with each other at one end in a maze-like configuration. The intermediate duct 52 which is somewhat larger in cross-sectional area than initial duct 42, is connected to initial duct 42 at their common ends by a curved chute 54. The discharge end of intermediate duct 52 opens into an enlarged plenum 60.

The enlarged plenum 60 serves the purpose of decreasing the velocity of the airstream such that lint particles are allowed to settle to the bottom of the plenum 60. Baffle plate 70 is positioned across the front part of the plenum 60 to further disperse the airstream and reduce the velocity thereof to assist in settling of the lint particles from the airstream.

Consequently, the warm, moist, lint-laden exhaust air from the dryer is introduced into the chamber through inlet port 34 and is conducted from the inlet port 34 upwardly through initial duct 42 into the curved chute 54 where its direction is reversed into a downward flow into intermediate duct 52 which has an enlarged cross-sectional area thereby reducing the velocity of the airstream to some extent. The air then continues flowing from intial duct 52 downwardly into the enlarged plenum 60 where its velocity is significantly reduced into the sides of the plenum and the airstream is dispersed by baffle plates 70. Since the airstream in the enlarged plenum 60 is effectively dispersed and reduced in velocity, it is no longer capable of carrying or sustaining the lint. Consequently, the lint L settles to the bottom of the plenum 60 as shown in FIG. 5. The air then exits in a dispersed manner through slots 72 and 78 in the baffle plate 70.

It is significant that the configuration of the baffle plate 70 is particularly adapted to enhance the efficiency of the scrubber action of the plenum 60 by providing an upper section 74 across the front portion of the top half of the plenum 60 and a lower inclined section 76 forwardly and downwardly from the common bend 75 between the upper vertical section 74 and the lower inclined section 76. This configuration provides the plenum 60 with a somewhat larger cross-section near the bottom than near the top, and the slope of the lower section 76 provides a more effective surface against which the flowing air near the bottom of the plenum impinges to reduce its velocity thereby allowing greater efficiency in settlement of the lint. It is also significant to note that the outlet slots 72 in the upper section 74 of the baffle plate are more numerous than the outlet slots 78 in a lower section of the baffle plate. This distribution of a substantial portion of the total cross-sectional area of the outlet holes in the baffle plate toward the upper portion provides the additional advantage of forcing most of the airstream to again reverse direction and flow upwardly in the plenum 60 in order to escape. This reversal of direction of the air in combination with the substantially lower velocity toward the central and lower portions of the plenum 60 further enhances the efficiency of the scrubber action for removing the lint L from the airstream.

Figure 4:
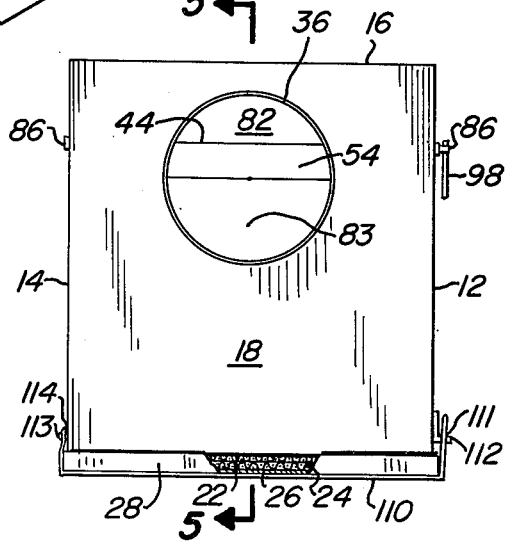
FIG. 4 is a plan view of the heat recovery device with the filter attached in place, a portion of the grill frame being cut away to reveal the relative position of the filter elements.

Even though the scrubber just described is quite efficient, there is always some portion of the lint in the airstream that does not settle out and is continuously carried through the outlet slots 72, 78 in the baffle plate 70. These particles of lint are usually finer and smaller in size, but it would still be undesirable to discharge these lint particles into the interior environment of a home. Therefore, after the air passes through the baffle plate 70, but prior to discharge into the home environment, it is forced to pass through a series of final filters 22, 24 which positively filter out the remaining lint in the airstream by physically prohibiting the lint particles from passing therethrough. As best seen in FIGS. 2–5, the final filter includes two filter elements 22, 24, positioned over the interior outlet opening 20 of the chamber. Each filter element is preferably comprised of expanded aluminum mesh and is retained in place over the opening 20 by a grill 26 supported by a grill frame 28. The internal length and width dimensions of the grill frame are slightly larger than the length and width dimensions of the chamber so that the grill frame 28 can be inserted over the edges of the chamber, as best seen in FIGS. 4 and 5.

The grill 26 and grill frame 28 are strapped in place across the interior outlet opening 20 by resilient or stretachable upper strap 110 and lower strap 116. The upper strap is permanently affixed at one end to the downwardly protruding lip 19 on the left side of the top lid 18 on anchor pin 114 by a fastener 113. The opposite end of the strap 110 has an eye 111 adapted for removable attachment to a similar anchor pin 112 on the opposite side of the top lid 18. The lower strap 116 is similarly permanently affixed at one end on the left side of the chamber in a similar manner by fastener 119 and has an eye 117 at its opposite end for removable attachment to anchor pin 118 on the lower right side of the chamber. Inwardly extending lips 13, 15 of side panels 12, 14, respectively, also assist in retaining the filter elements 22, 24 in place by preventing them from falling inwardly into the interior outlet opening 20.

For convenience of removing lint from the scrubber, a removable lint tray 100 is provided at the bottom of the plenum 60, as best seen in FIGS. 2 and 5. The lint tray 100 includes a flat bottom portion 102 positioned on the bottom of the plenum 60 and a front panel 101 extending upwardly from the flat bottom portion 102 near the forward portion of the tray 100. Since it is important to eliminate any air flow or current in the bottom portion of the plenum 60 in order to allow complete settlement of the lint in that portion of the plenum, a fabric seal 106 such as felt, is provided in the front panel portion 101 of the lint tray 100 to seal around the edges of the front panel 101. As best seen in FIG. 5, this seal 106 is retained in the panel 101 between a front clamping plate 104 and a back retainer plate 105. As illustrated in FIGS. 3 and 5, this fabric seal 106 seals the front panel 101 of the tray 100 against both the sides and the top of the tray access opening defined by the sides 12, 14 of the chamber and a forwardly extending lip 77 of the baffle plate 70.

Tray guides 108 are provided on both sides of the plenum 60 to guide the flat bottom portion 102 of the lint tray 100 into its proper horizontal position at the very bottom of the plenum 60. It can be appreciated therefore that lint L in the plenum 60 will settle on the flat bottom portion 102 of the lint tray 100 and can be removed from the plenum by removing the tray 100 from the plenum and disposing of the lint thereon. To facilitate removal, a handle 107 is provided on the forward face of the front panel 101 of the tray 100.

Since it may not always be desirable to divert all of the warm moist air from the dryer into the interior environment of a home, such as during the summer when the primary object of the occupants will be to cool the interior air and de-humidify it rather than heat and humidify it, the heat recovery device of the present invention is also provided with a bypass so that the dryer exhaust air can be vented to the outside of the home in the conventional manner when desired. Referring again to FIGS. 4 and 5, a bypass duct 82 is provided at the rear of the chamber to conduct the exhaust air from inlet port 34 to outlet port 36 which is connected into the conventional exhaust vent pipe leading to the outside of the home. The bypass duct 84 is defined by the back panel 16 of the chamber, side panels 12, 14 of the chamber, and partition 44 which extends downwardly to the vicinity of the inlet port 34.

A damper or valve 84 is pivotally mounted on a shaft 86 extending transversely from one side of the chamber to the other at the bottom of partition 44 such that the valve plate is rotatable to close off the entrance to the bypass duct 82 and divert the flow of air into the initial duct 42 in the position shown in FIG. 5 or alternatively to block off the initial duct 42 and divert the flow of air into bypass duct 82 as illustrated by the position shown in phantom lines 96. A fabric seal 90 made of felt fabric is also provided to seal the sides and ends of the valve 84. The fabric seal 90 is held in place by being sandwiched between facia plates 88 and 89 allowing a small portion of the fabric to extend beyond the sides and ends of the plates to effect the seal.

Similar fabric seals 94, 95 are provided around the shaft 86 and are secured in place by being positioned between partition 44 and a clamping plate 92. The cross shaft 86 extends from one side of the chamber through to the exterior of the other side as best seen in FIGS. 2–4. A control handle 98 is also provided on the right end of shaft 86 to facilitate manual operation of the gate valve 84 from the outside of the heat recovery device 10.

It is readily apparent that the valve 84 can be adjusted at any position intermediate of deflecting the airstream to either the initial duct 42 or the bypass duct 82 to allow only a portion of the air to be discharged into the interior environment as desired.

Since the inlet and outlet ports 34, 36, respectively, are of standard diameter for conventional exhaust vent pipes, the lower portion of partition 46 is slanted downwardly and forwardly to form an inclined deflector chute 62 to direct the incoming stream of air to the zone occupied by the valve 84 near the respective mouths of initial duct 42 and bypass duct 82. A similar upper inclined deflector chute 83 is also provided near the top of the bypass duct 82 extending from the curved chute 54 to the upper lid near the forward side of outlet port 36. Both the lower deflector chute 62 and the upper deflector chute 83 enhance the laminar flow of the stream of air into and out of the chamber and minimize locations of turbulence or locations which may tend to collect deposits of lint.

Although the present invention has been described with a certain degree of particularity, it is understood that the present disclosure has been made by way of example and that changes in detail of structure may be made without departing from the spirit thereof.

What is claimed is:

1. Exhaust heat recovery apparatus for clothes dryers and the like, comprising:

an enclosed chamber having an inlet port for receiving exhausted air from a clothes dryer, and an indoors exhaust opening through which the dryer exhaust air is discharged into the interior environment of the home; and scrubber means within said chamber for removing lint from the exhausted dryer air prior to discharging said air through said indoors exhaust opening, said scrubber means including a plurality of partitions forming an elongated entry flow passage and an intermediate flow passage, said entry flow passage having one end in communication with said inlet port and the opposite end in communication with said intermediate flow passage, said intermediate flow passage being of larger cross-sectional area than said entry flow passage, said scrubber means further including an enlarged plenum for reducing the velocity of flow of the dryer air stream through said chamber, baffle means substantially dividing said plenum into at least two sections, and a plurality of flow passage means extending through said baffle means, said sections being in fluid communication with one another through said plurality of flow passage means, said intermediate flow passage communicating with one of said sections and said indoors exhaust opening communicating with the other of said sections.

2. The apparatus of claim 1, wherein said entry and said intermediate flow passages are located along side each other and communicatively connected together at a common end so that the flow through said entry passage and into said intermediate flow passage undergoes a 180° reversal in direction.

3. The apparatus of claim 1, wherein said flow passage means being a plurality of spaced-apart holes therethrough forms a wall of said plenum.

4. The apparatus of claim 3, wherein the combined area of said holes in the upper portion of said baffle means is larger than the combined area of said holes in the lower portion to diffuse a larger portion of the air flow to the upper portion of said plenum than to the lower portion.

5. The apparatus of claim 3, wherein said scrubber means also includes filter means across said indoors exhaust opening for catching and retaining any lint particles still being carried by the air upon flowing out of said plenum through said holes.

6. The apparatus of claim 3, including cleaning means for removing lint deposited at the bottom of said plenum.

7. The apparatus of claim 6, wherein said cleaning means includes a tray slidably positioned on the bottom of said plenum, upon which lint is deposited, said tray being slidably removable from said plenum for removing the deposited lint for disposal, there being sealing means between an edge of said tray and said plenum for decreasing leakage of air from the space between said plenum and said tray.

8. The apparatus of claim 3, including an outdoors exhaust opening, a bypass duct, one end of which is in communication with said inlet port and the opposite end of which is in communication with said outdoors exhaust opening, and a damper mounted in said chamber on an edge of one of said partitions and operative for selectively controlling relative amounts of air entering said chamber through said inlet port through said scrubber means to said indoors exhaust opening and into said bypass duct to said outdoors exhaust opening.

9. The apparatus of claim 2, wherein said entry flow passage and said intermediate flow passage are connected by a curved chute.

10. The apparatus of claim 1, wherein one side of said intermediate flow passage is a partial partition extending downwardly into the said enlarged plenum from the upper portion of said plenum a distance less than one-half the height of said plenum.

11. Heat recovery apparatus for clothes dryers and the like, comprising an enlarged plenum having a box-like shape with a top, a bottom and four sides, said top, said bottom and three of said sides being solid panels, one of said panels having an inlet opening therethrough for accommodating inflow of the exhaust airstream from the dryer into said plenum, and said fourth side being a baffle plate having a plurality of outlet holes therethrough to discharge the dryer exhaust air introduced into said plenum, said holes in said baffle plate being spaced apart from each other and dispersed over the surface area of said baffle plate with a substantially larger proportion of said holes being located in the upper portion of said baffle plate than in the lower portion to encourage a substantially larger proportion of air to flow to the upper portion of said plenum to escape than to the lower portion whereby to enhance deposit of lint on the bottom of said plenum.

12. The heat recovery apparatus of claim 11, wherein said inlet opening is located in the upper portion of said plenum and a substantially vertical duct is connected to said inlet opening to direct the flow of air entering said plenum downwardly whereby the air in said plenum must change direction of flow substantially upward to escape through the concentration of said holes in the upper portion of said plenum.

13. The heat recovery apparatus of claim 12, including an initial air passage oriented to conduct the flow of dryer air substantially upwardly where it is connected to and opens into the upper end of said vertical duct, the connection between said initial air passage and said vertical duct being in the form of a curved chute to change the direction of the upwardly flowing air in said initial air passage to downward flow into said vertical duct, said initial air passage also being of smaller cross-sectional area than said vertical duct so that the velocity of flow of the dryer air is reduced upon entering said vertical duct.

14. The heat recovery apparatus of claim 12, including a bypass duct for conducting the flow of exhaust air past said plenum for discharge outside a home, and valve means for selectively deflecting the flow of exhaust air or any portion thereof into said plenum and alternatively deflecting the flow of exhaust air or any portion thereof into said bypass duct.

15. The heat recovery apparatus of claim 12, including final filter means downstream from said baffle plate for positively filtering remaining lint particles out of the exhaust air prior to discharge of the exhaust air into the interior environment of the home.

16. The heat recovery apparatus of claim 12, including a tray positioned at the bottom of said plenum for holding lint deposited thereon, said tray being slidably removable from said plenum for removing the lint from the plenum for disposal.

17. Exhaust heat recovery apparatus for clothes dryers and the like, comprising:

a box-like enclosure having a top panel, bottom panel, rear panel, and two opposite side panels, all of said panels being joined to adjacent of said panels at their respective edges, the front of said enclosure being open;

inlet means in the lower rear portion of said enclosure for allowing exhaust air from the clothes dryer to enter said enclosure;

a first flow passage in the rear portion of said enclosure in air flow communication with and extending upwardly from said inlet means to the upper rear portion of said enclosure;

a large chamber in the front portion of said enclosure between said open front and said first flow passage and communicating with an indoors exhaust opening;

a second flow passage in air flow communication with said first flow passage and which extends from the upper end of said first flow passage downwardly into said chamber where said second flow passage opens into said chamber;

baffle means substantially dividing said chamber into at least two sections, and a plurality of flow passage means extending through said baffle means, said sections being in fluid communication with one another through said plurality of flow passage means, said second flow passage communicating with one of said sections and said indoors exhaust opening communicating with the other of said sections;

lint container means on the bottom of said chamber for holding the lint particles deposited thereon; and filter means across said open front of said enclosure and defining a wall across a second one of said two sections and adapted for filtering lint particles out of the air which flows out of said chamber through said open front of said enclosure.

18. The exhaust heat recovery apparatus of claim 17, including alternate outlet means in the upper portion of said enclosure for allowing exhaust air from the clothes dryer to exit said enclosure, and valve means in said enclosure for selectively diverting the air flow in said enclosure to said outlet means and to said open front.

19. The exhaust heat recovery apparatus of claim 18, wherein said alternate outlet means is connected in flow communication to said first flow passage, and said valve means is connected to said alternate outlet means and said first flow passage and is positionable alternatively to block air flow through said outlet means and through said first and second air passages.

20. The exhaust heat recovery apparatus of claim 17, wherein said baffle means is a plate extending substantially over the entire front portion of said chamber and having a plurality of spaced-apart holes therethrough, and said container means is a removable tray positioned on the bottom of said chamber and slidable inwardly and outwardly of said chamber.

21. The exhaust heat recovery apparatus of claim 20, wherein said tray is slidable inwardly and outwardly of said chamber under said plate and said filter means is a mesh material positioned over said open front adjacent both said plate and the front of said tray, said mesh material being removable for cleaning and to allow said tray to be removed from the front of said chamber.

22. The exhaust heat recovery apparatus of claim 17, wherein said second flow passage extends downwardly in the upper rear portion of said chamber to a location above mid-height of said chamber, at which location said second flow passage opens into said chamber.

23. Exhaust heat recovery apparatus for clothes dryers and the like comprising:

a plenum;

a baffle plate substantially dividing said plenum into two sections, said baffle plate having a plurality of spaced-apart holes in open communication with both said sections, said holes operative to diffuse the flow of air through said plenum and wherein the combined area of said holes in the upper portion of said baffle plate is larger than the combined area of said holes in the lower portion of said baffle plate so as to diffuse a larger portion of the air flow to the upper portion of said plenum than to the lower portion;

an inlet port for receiving exhausted air from a clothes dryer, said inlet port in fluid communication with a first one of said sections; and an exhaust port in fluid communication with a second one of said sections for said exhausted air therefrom.

* * * * *